United States Patent [19]

Meador

[11] Patent Number: 4,889,050

[45] Date of Patent: Dec. 26, 1989

[54] APPARATUS AND METHOD FOR DECORATING TUBULAR CONTAINERS AND LIKE ITEMS

[75] Inventor: Neil A. Meador, Montvale, N.J.

[73] Assignee: Permanent Label Corporation, Clifton, N.J.

[21] Appl. No.: 251,197

[22] Filed: Sep. 29, 1988

[51] Int. Cl.[4] ..... B41F 17/22

[52] U.S. Cl. ..... 101/38.1; 101/485

[58] Field of Search ..... 101/38.1, 40.1, 39, 101/40, 7, 485

[56] References Cited

U.S. PATENT DOCUMENTS

| | | | |
|---|---|---|---|
| 2,635,533 | 4/1953 | Stewart | 101/40 |
| 3,024,722 | 3/1962 | Jamison, Sr. et al. | 101/40 |
| 3,405,633 | 10/1968 | Price, Jr. et al. | 101/40.1 X |
| 3,538,845 | 11/1970 | Peck et al. | 101/40.1 |
| 3,564,998 | 2/1971 | Johnson et al. | 101/40 |
| 3,979,247 | 9/1976 | Berg | 101/40 X |
| 4,469,022 | 9/1984 | Meador | 101/38.1 |
| 4,502,380 | 3/1985 | Meador | 101/38.1 |

*Primary Examiner*—Clifford D. Crowder
*Attorney, Agent, or Firm*—Samuelson & Jacob

[57] ABSTRACT

Apparatus and method for decorating a surface of a tubular container with a decorating medium applied by a decorating device, at an area of transfer at the decorating surface of the decorating device, utilizing a single drive motor coupled with the container for registering the container for decoration and then effecting relative rotation and translation between the container and the decorating device, the drive motor being operated in a first mode of operation for accomplishing registration of the container relative to the decorating device, and then being operated in a second mode of operation in which the container is rotated at a rate related ratiometrically to the rate of translation to effect essentially rolling contact between the container and the decorating surface of the decorating device so that the relative velocity between the surface of the container and the decorating surface of the decorating device is maintained at zero at the area of transfer of the decorating medium.

16 Claims, 6 Drawing Sheets

APPARATUS AND METHOD FOR DECORATING TUBULAR CONTAINERS AND LIKE ITEMS

The present invention relates generally to the decoration of containers and like items and pertains, more specifically, to apparatus and method in which a tubular container, or a similar item, and a decorating device first are oriented in appropriate registration relative to one another and then are subjected to relative movement to establish the decoration, placed in accurate registration, on the surface of the item.

The decoration of tubular containers is a highly developed art. Increased demands for a wider variety of products packaged in more attractive dress has led to the development of machines and techniques capable of accomplishing decoration on tubular containers of various dimensions with increased accuracy and at higher rates of production. Usually, these machines and techniques involve the placement of the containers at a decorating station, registration of the container relative to a decorating device and then moving the container relative to the decorating device to transfer a decorating medium to the container. Rather elaborate mechanical movements have been utilized to accomplish the necessary registration and decorating manipulations. These mechanical movements often are constructed to accommodate containers of specified dimensions and configurations and require considerable modification when it is desired to changeover to the decoration of containers of different size and shape.

The present invention furthers the development of apparatus and techniques which enable greater versatility, and provides several objects and advantages, some of which may be summarized as follows: Simplified design and construction and ease of use of apparatus and procedures capable of decorating tubular containers and like items having a wide variety of dimensions and configurations; Increased rates of production and reduced downtime in the decorating of containers of various sizes and shapes; Increased accuracy in the registration of decoration on the surface of a tubular container, or a like item; Increased versatility and economy as a result of the ability of a single apparatus to be adapted readily for use in a wider variety of decorating operations; Rugged construction for long-term dependable service.

The above objects and advantages, as well as further objects and advantages, are attained by the present invention which may be described briefly as an improvement in apparatus and method for decorating a surface of a tubular container, or a similar item, with a decorating medium by registering the surface of the container appropriately relative to a corresponding surface of a decorating means and effecting relative movement of the container along the decorating means to transfer the decorating medium from the surface of the decorating means to the surface of the container, while maintaining at zero the relative velocity between the surface of the container and the surface of the decorating means at an area of transfer of the decorating medium from the surface of the decorating means to the surface of the container, the container having a registration mark thereon and being held upon a holder coupled to a motor for rotating the holder and the container thereon in response to operation of the motor, the improvement comprising the steps of and means for: operating the motor in a first mode of operation to bring the registration mark toward a predetermined position relative to the decorating means; detecting the location of the registration mark when the registration mark is placed at the predetermined position relative to the decorating means; bringing the surface of the container and the surface of the decorating means into contact at the area of transfer of the decorating medium when the surface of the container is registered appropriately relative to the corresponding surface of the decorating means; subsequently operating the motor in a second mode of operation independent of the first mode of operation; and effecting relative translation between the container and the decorating means while operating the motor in the second mode of operation, with the rate of rotation of the container related to the rate of translation such that the relative velocity between the surface of the container and the corresponding surface of the decorating means is maintained at zero at the area of transfer of the decorating medium.

The invention will be understood more fully, while still further objects and advantages will become apparent, in the following detailed description of preferred embodiments of the invention illustrated in the accompanying drawing, in which.

Figure 1:
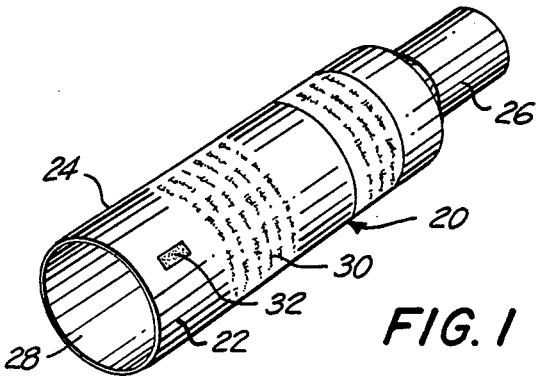
FIG. 1 is a perspective view of a typical container to be decorated in accordance with the method and apparatus of the invention.

Referring now to the drawing, and especially to FIG. 1 thereof, a container to be decorated in accordance with the method of the present invention, utilizing apparatus of the invention, is illustrated at 20 and is seen to have a cylindrical tubular body 22 with a surface 24 upon which the decoration is to be applied. A cap 26 is placed on the container 20 at one end thereof, and the other end of the tubular body 22 is open at 28 for subsequent filling and closing. The surface 24 of the body 22 of container 20 already has been provided with some text 30, as by a previous printing operation, and a registration mark 32 is placed on the container 20 in a predetermined location relative to the text 30 and the surface 24 upon which further decoration is to be applied. In this instance, registration mark 32 is printed upon the surface 24 of the container 20 for detection by optical means, as will be described more fully below.

Figure 2:
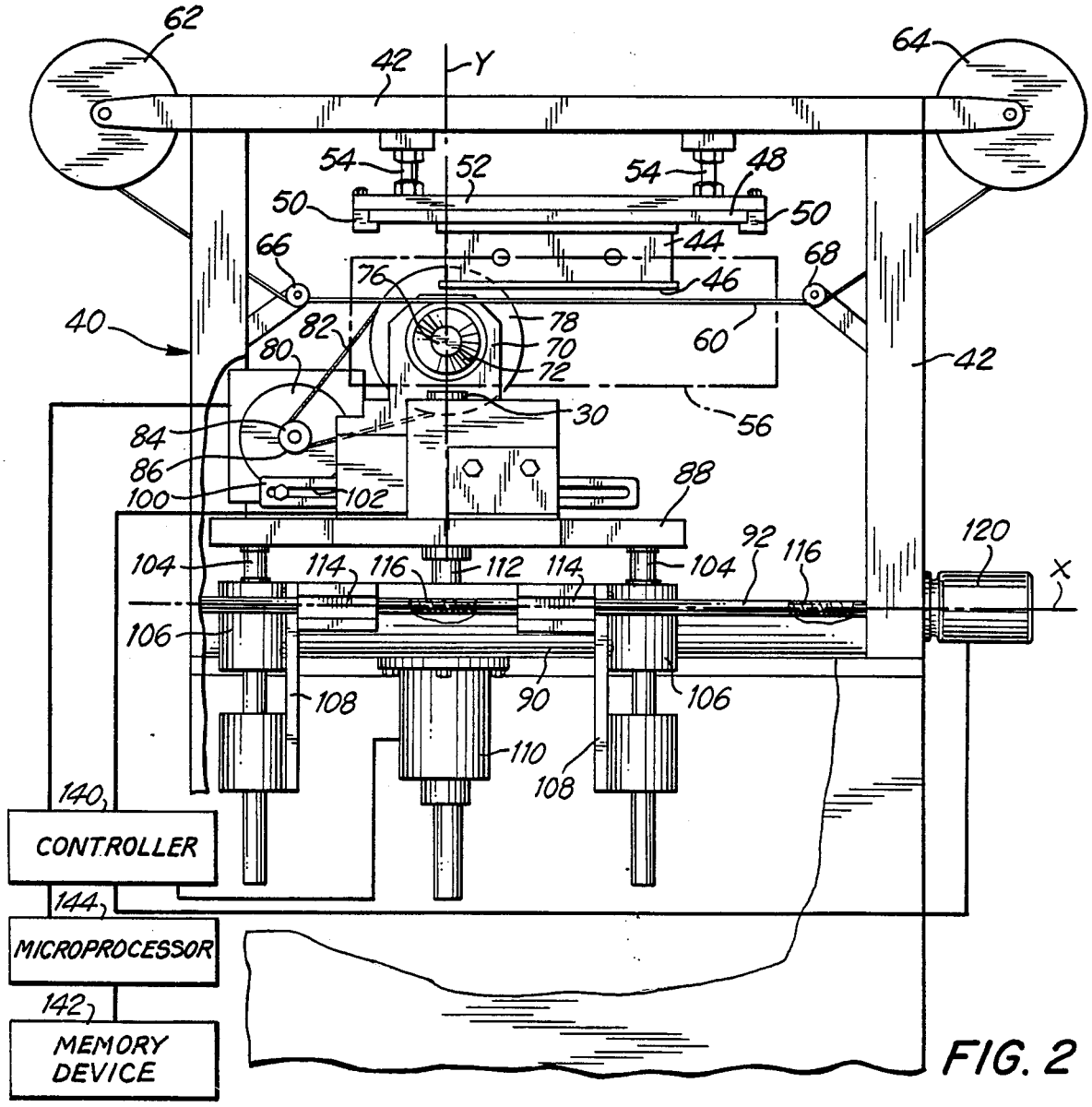
FIG. 2 is a partially schematic front elevational view, with portions broken away, of an apparatus constructed in accordance with the present invention.
Figure 3:
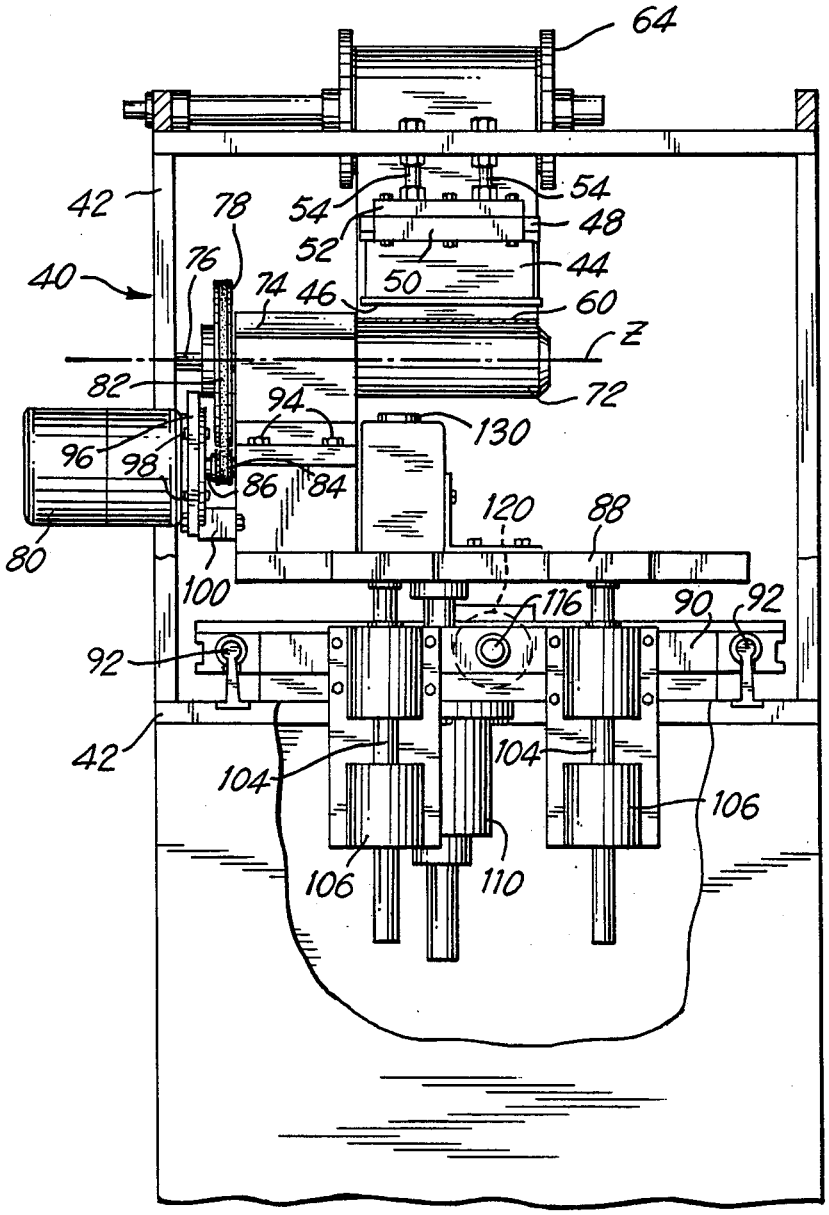
FIG. 3 is side elevational view of the apparatus, partially broken away to illustrate component parts thereof.

Turning now to FIGS. 2 and 3, an apparatus constructed in accordance with the invention is illustrated in the form of machine 40 which is configured for decorating container 20 utilizing hot stamping techniques. Thus, machine 40 includes a frame 42 which supports, adjacent the top thereof, a heated platen 44 having a decorating surface 46 which carries the pattern for the decoration to be applied to the surface 24 of the container 20 in a manner now conventional in connection with hot stamping. The heated platen 44 includes a base plate 48 which is clamped, by means of clamps 50, to a support plate 52 suspended from the frame 42, and affixed thereto, by studs 54, so as to place the heated platen 44 within a decorating station 56 in the machine 40. A hot stamping foil 60 is threaded through the station 56, between a supply spool 62 and a take-up spool 64, both of which spools 62 and 64 are mounted upon the frame 42. Guide rollers 66 and 68 maintain the appropriate placement of the length of foil 60 within the decorating station 56.

A holder 70 for holding the container 20 immediately below the platen 44 and the foil 60 within the decorating station 56 includes a mandrel 72 mounted for rotation in a bearing block 74 about a generally horizontal axis of rotation Z. To this end, mandrel 72 is carried by a spindle 76 upon which is mounted a pulley 78 coupled to a drive motor 80, through a drive belt 82 and a drive pulley 84 mounted on the motor shaft 86. Preferably, the pulley 78, the drive pulley 84 and the drive belt 82 are toothed so as to be locked positively into synchronism. Both the bearing block 74 and the drive motor 80 are mounted upon a platform 88 which itself is carried by a carriage 90 supported upon parallel rails 92 affixed to the frame 42 of the machine 40. Thus, the bearing block 74 is bolted, at 94, to the platform 88, while the drive motor 80 is secured to a mount 96 which is bolted, at 98, to a bracket 100 affixed to the platform 88, bracket 100 having a slot 102 therein so as to permit selective adjustment of the position of the drive motor 80 along the bracket 100.

Platform 88 includes a plurality of depending rods 104, all of which rods 104 are parallel to one another and are perpendicular to platform 88. Rod 104 are received within complementary sleeves 106 carried by mounting plates 108 affixed to the carriage 90 so that the platform 88 is movable relative to the carriage 90 in upward and downward directions along a generally vertical axis Y. An actuator in the form of an air cylinder 110 is carried by the carriage 90 and is coupled to the platform 88, by means of a drive rod 112, to effect movement of the platform 88 in a manner which will be described in greater detail below. The carriage 90 includes threaded followers 114 affixed to the carriage 90 and engaged by a lead screw 116 which is coupled to another actuator in the form of a second motor 120 mounted upon frame 42 for rotation of the lead screw 116 about a generally horizontal axis X to move the carriage 90 in directions along the axis X. Accordingly, mandrel 72 may be translated in horizontal directions along the X axis, may be moved in vertical directions along the Y axis, and may be rotated about the Z axis, upon selective actuation of the motor 120, the air cylinder 110, and the drive motor 80, respectively.

Figure 4:
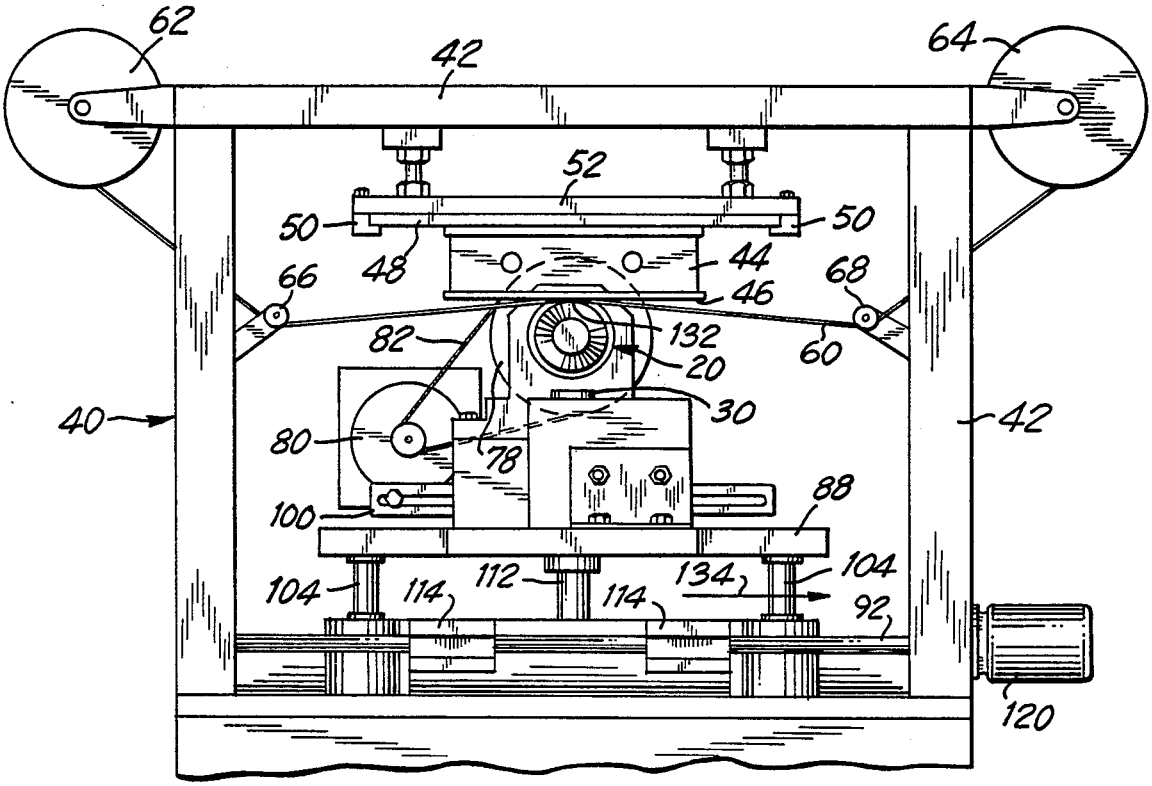
FIG. 4 is a fragmentary front elevational view of the apparatus showing component parts in another operating position.
Figure 5:
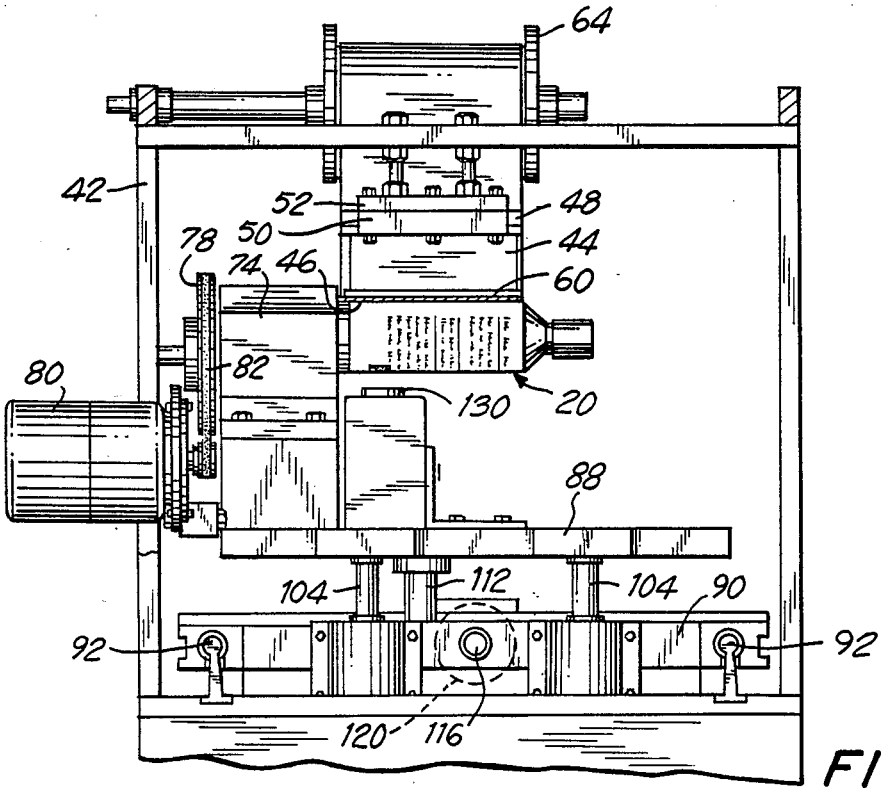
FIG. 5 is a fragmentary side elevational view of the apparatus as shown in FIG. 4.

In the position of the component parts of the machine 40 illustrated in FIGS. 2 and 3, the container holder 70 is in a starting, or home position within the decorating station 56, spaced downwardly from the platen 44 and the foil 60, so that the container 20 can be loaded onto the holder 70 by sliding the cylindrical tubular body 22 of the container 20 onto the mandrel 72 which is inserted through the open end of the body 22 at 28. As best seen in FIGS. 4 and 5, the container 20 has been seated fully on the mandrel 72, and the drive motor 80 has been operated to rotate the mandrel 72, with the container 20 seated thereon, so as to register the surface 24 of the container 20 appropriately relative to the decorating surface 46 of the heated platen 44. Detector means is provided in the form of a photodetector 130 carried upon the platform 88 and located immediately below the mandrel 72 in position to detect the placement of the registration mark 32, located on the surface 24 of the container 20, in juxtaposition with the photodetector 130 and the concomitant placement of the container surface 24 in a predetermined position relative to the decorating surface 46 of the platen 44. The air cylinder 110 has been actuated to elevate the platform 88 and urge the container surface 24 against the decorating surface 46 of the platen 44, with the foil 60 interposed therebetween, so that the decorating medium provided by the foil 60 will be transferred to the container surface 24 along an area of transfer 132 between the container surface 24 and the decorating surface 46. Motor 120 has been operated subsequently to rotate lead screw 116 and move carriage 90 to translate the holder 70, and the container 20 thereon, in the direction of the arrow 134 in FIG. 4, while, at the same time, drive motor 80 is operated to rotate the mandrel 72, and the container 20, at a rate of rotation so related to the speed of translation as to assure that the container 20 remains in rolling contact with the foil 60 and the platen 44; that is, the relative velocity between the container surface 24 and the decorating surface 46 remains at zero along the area of transfer 132 of the decorating medium. Upon completion of the traverse of the decorating surface 46 of the platen 44 by the container surface 24, the decorating operation will be complete and the air cylinder 110 will be actuated to move the mandrel 72 downwardly, so as to retract the container from the platen 44 and the foil 60 for removal of the now fully decorated container 20 from the holder 70.

Referring back to FIG. 2, each of the actuators, namely, drive motor 80, air cylinder 110 and second motor 120, and the photodetector 130, are coupled with a controller 140 for controlling the sequence and manner of operations described above. The controller 140, in turn, operates in accordance with a program provided by a memory device 142 through a microprocessor 144. The construction and operation of machine 40 is simplified in that the single drive motor 80 is a servo motor and is operated in different modes to accomplish the different functions of registering the container 20 relative to the decorating surface 46 of the platen 40 and then rotating the container 20 for decorating the surface 24 of the container. By operating the drive motor 80 in these different modes, the need for elaborate mechanical movements to accomplish the separate functions of registration and then decoration is eliminated, and each function may be accomplished in the most effective manner independent of the other function while still utilizing only a single drive motor and drive train. In addition, the use of a memory device and a microprocessor enables machine 40 to be adapted readily for use with containers of various dimensions without the necessity for expensive changes in mechanical components to accommodate each new size.

Figure 6:
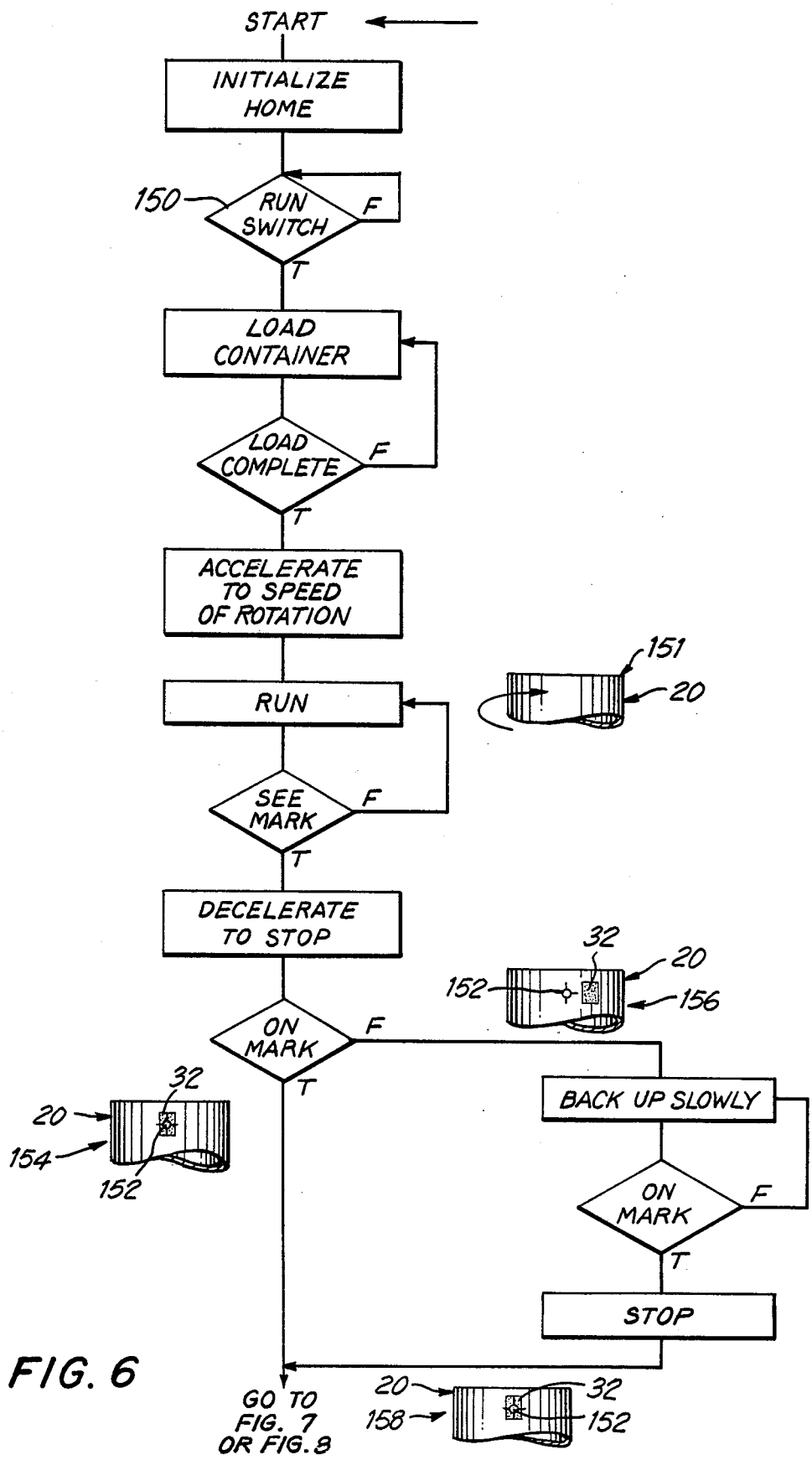
FIG. 6 is a flow chart, with accompanying diagrammatic illustrations, depicting a sequence of operations in the apparatus and method of the invention.

The sequence of operation of the drive motor 80 in the first mode of operation, that is, the mode in which the container 20 is rotated until the surface 24 of the container is registered in appropriate position relative to the decorating surface 46 of the platen 44, is illustrated diagrammatically beginning with FIG. 6. Upon the start of a cycle of operation, run switch 150 is placed in a run position and all of the operating components are initialized to a home position, as depicted in FIGS. 2 and 3. A container 20 is loaded by placement on the mandrel 72, as described above. Once the loading is complete, the drive motor 80 is accelerated to a constant speed of rotation, the program runs to rotate container 20 as depicted at 151, and the registration mark 32 is sought by the photodetector 130. When the photodetector 130 detects, or "sees", the registration mark 32, the drive motor 80 is decelerated to a stop. If, upon coming to a complete stop, the container 20 is registered so that the registration mark 32 coincides with the fixed sensing point 152 defined by the position of the photodetector 130, as seen at 154 in the diagrammatic illustration of FIG. 6, the initial portion of the registration procedure is complete. However, since the registration mark 32 may vary in color contrast or in width from container to container, and since there is a certain amount of inertia in the system, rotation of the container may continue beyond the position shown at 154, to the position shown at 156, wherein the container 20 has come to rest with the registration mark 32 located beyond the fixed sensing point 152 in the direction of rotation of the container. Under those circumstances, rotation of the drive motor 80 will be reversed and the mandrel 72, with the container 20 thereon, will be backed up slowly until the registration mark 32 once again coincides with the fixed sensing point 152, to bring the container to the position shown at 158.

Figure 7:
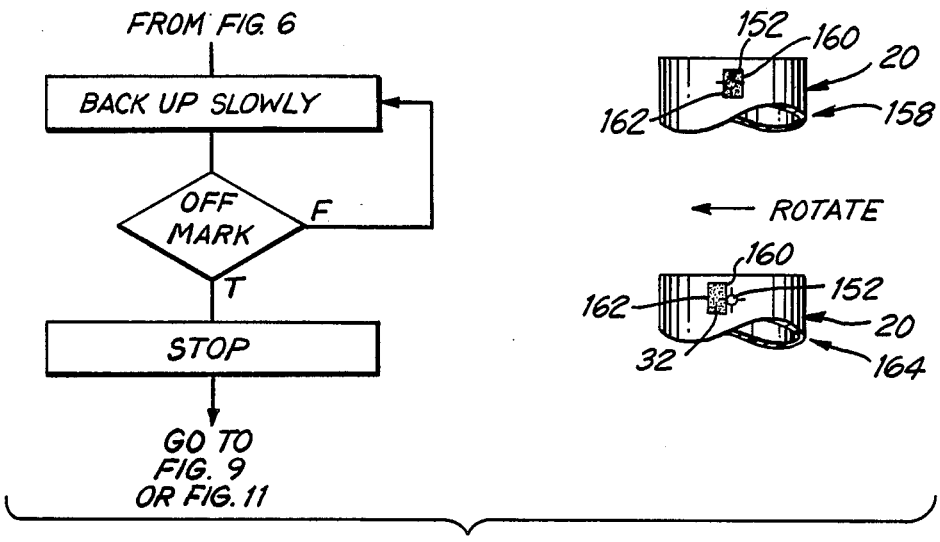
FIGS. 7 and 8 are flow charts, with accompanying diagrammatic illustrations, depicting alternate sequences of operation.
Figure 8:
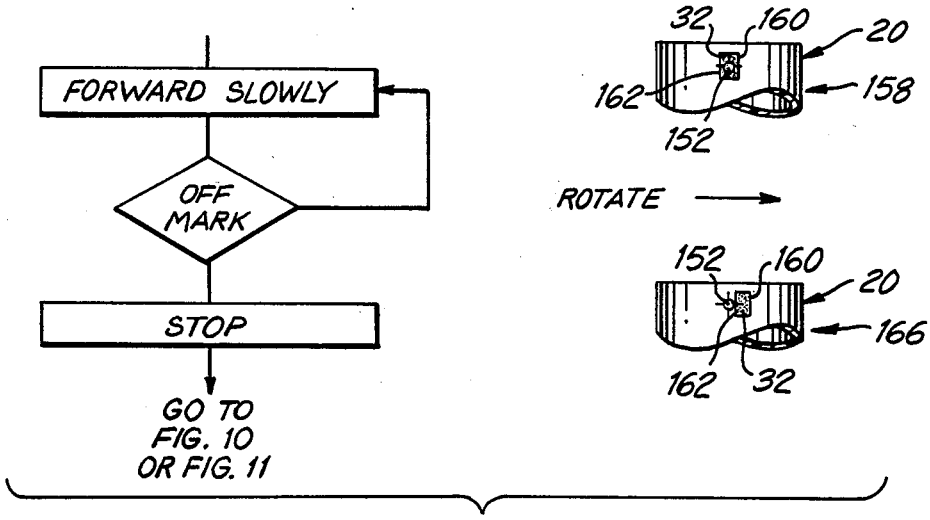

Turning now to FIGS. 7 and 8, since the registration mark 32 has a finite width, more accurate registration is attained by aligning an edge of the registration mark 32 with the fixed sensing point 152. Thus, the registration routine is continued by rotating the container 20 quite slowly until the photodetector 130 indicates that the registration mark 32 is just beyond the fixed sensing point 152 or, in other words, the fixed sensing point 152 is located just off the registration mark 32. Depending upon the location of the registration mark 32 on the container surface 24, and the width of the registration mark 32, The registered position of the container 20 is chosen so that the fixed sensing point 152 is located just off the registration mark 32, adjacent either the leading edge 160 or the trailing edge 162 of the registration mark 32. As seen in FIG. 7, the registration routine is continued by rotation of the container 20 slowly in a reverse direction until the fixed sensing point 152 is located just off the registration mark 32, to that registration of the container 20 is completed by placing the leading edge 160 of the registration mark 32 adjacent the fixed sensing point 152, as depicted at 164. In the alternative, as seen in FIG. 8, the registration routine is continued by rotation of the container 20 slowly in the forward direction until the fixed sensing point 152 is located just off the registration mark 32, so that registration of the container is completed by placing the trailing edge 162 of the registration mark 32 adjacent the fixed sensing point 152, as depicted at 166.

Figure 9:
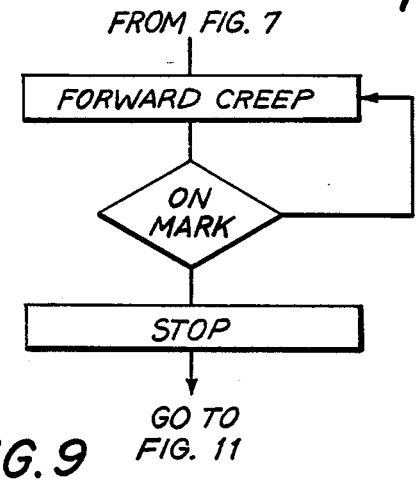
FIGS. 9 and 10 are flow charts illustrating optional additional operations.
Figure 10:
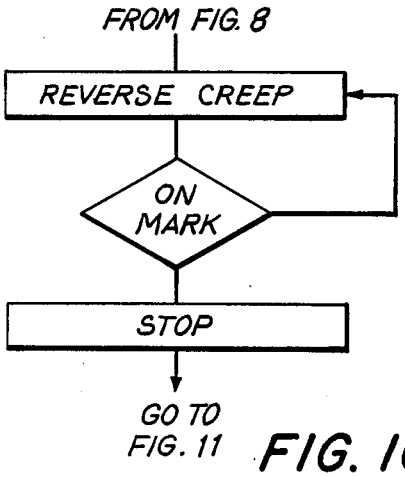

While either of the two alternate routines described in connection with FIGS. 7 and 8 will bring the container 20 into registration with a sufficient degree of accuracy for most purposes, still greater accuracy can be achieved, when desired, by continuing the registration routine in the manner illustrated in FIGS. 9 and 10. Thus, where rotation of the container 20 has been discontinued with the fixed sensing point 152 located just off the registration mark 32 adjacent the leading edge 160 thereof, as shown in FIG. 7, rotation of the container 20 may be continued in a forward direction at a very slow rate, as indicated by a forward creep operation in the extended routine illustrated in FIG. 9, until the fixed sensing point 152 coincides with the registration mark 32 at the leading edge 160 thereof. Likewise, where rotation of the container 20 has been discontinued with the fixed sensing point 152 located just off the registration mark 32 adjacent the trailing edge 162 thereof, as shown in FIG. 8, rotation of the container 20 may be continued in a reverse direction at a very slow rate, as indicated by a reverse creep operation in the extended routine illustrated in FIG. 10, until the fixed sensing point 152 coincides with the registration mark 32 at the trailing edge 162 thereof. The edge-finding routines described in connection with FIGS. 7 through 10 compensate for the effects of inertia and machine tolerances in attaining accurate registration of the container 20 for enhanced decoration of the surface 24 of the container 20 in a practical manner.

Figure 11:
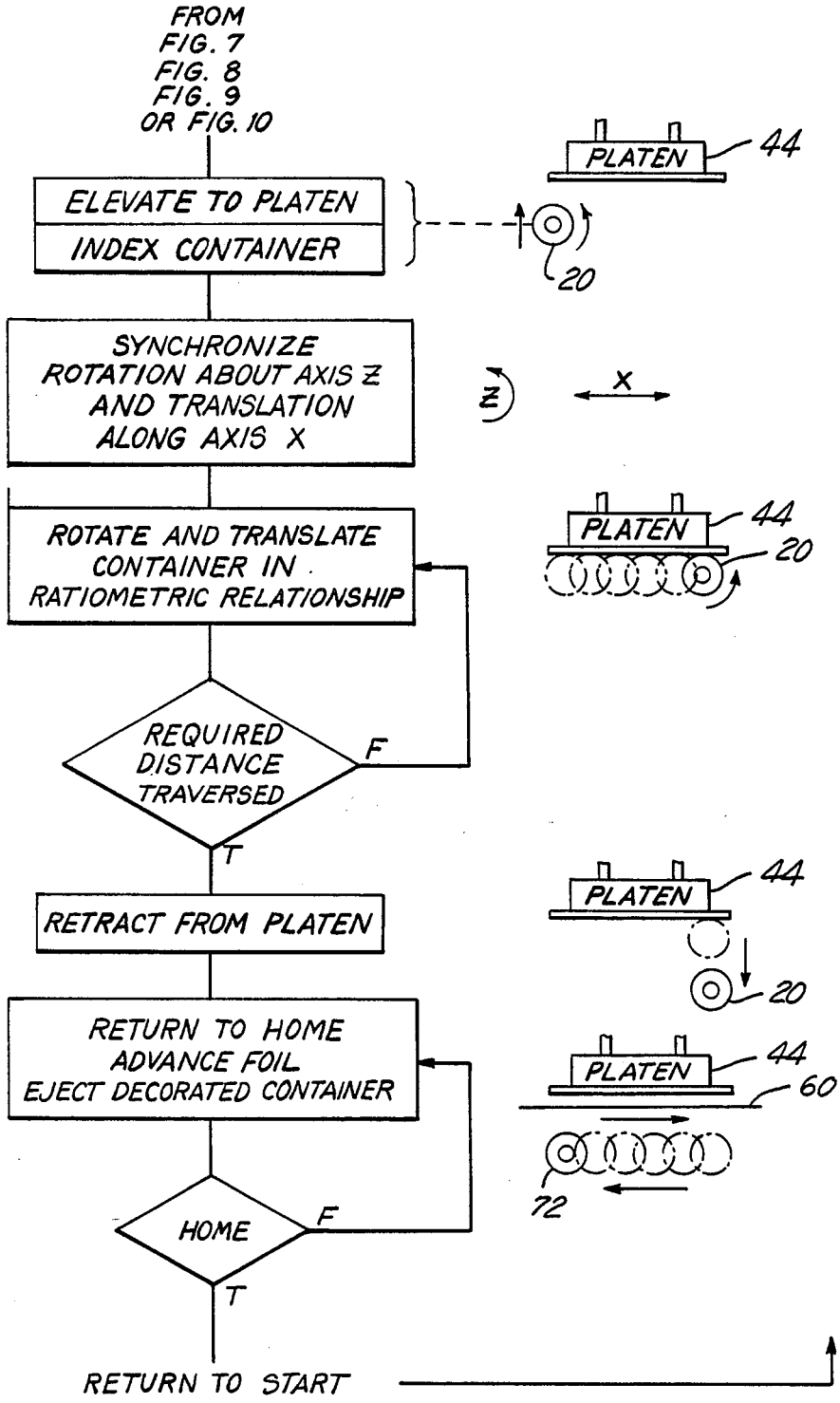
FIG. 11 is a flow chart, with accompanying diagrammatic illustrations, depicting a further sequence of operations in the apparatus and method of the invention.

Upon completion of the registration of the container 20, as described above in connection with FIGS. 6 through 10, the container is placed at the predetermined position relative to the decorating surface 46 of the platen 44, and container surface 24 is ready to be decorated by means of a routine illustrated in FIG. 11. The first step in that routine is to elevate the container 20 by actuating the air cylinder 110 to raise the platform 88 and the holder 70 carried thereby. Since, in most instances, the predetermined position of the container 20, that is, the position where the registration mark 132 is registered in juxtaposition with the photodetector 130, as described above, is not necessarily the position where the surface 24 of the container 20 is in the required angular registration with the decorating surface 46 of the platen 44 for commencement of the application of decorating medium to the surface 24, drive motor 80 is actuated to rotate the mandrel 72 prior to the engagement of the surface 24 of the container 20 with the decorating surface 46 of the platen 44 through a given angular displacement so that the portion of the surface 24 to be decorated is registered properly with the decorating surface 46 upon engagement of the container surface 24 with the decorating surface 46. Such indexing of the container 20 is accomplished in accordance with the program provided by memory device 142 and enables machine 40 to accommodate containers in which the registration mark 32 is placed at almost any known angular location around the periphery of the container surface 24.

In the next step of the routine, the mode of operation of the drive motor 80 is changed and the actuation of the drive motor 80 is synchronized with the actuation of second motor 120, and the concomitant translation of the carriage 90, so that there is established a positive coupling between the translation of the container 20 along the X axis and the rotation of the container 20 about the Z axis. The rate of rotation of the container 20 is related to the rate of translation of the container 20 by a ratio which assures that the relative velocity between the surface 24 of the container 20 and the decorating surface 46 of the platen 44 is maintained at zero at the area of transfer 132. In effect, rolling contact is maintained between the surfaces 24 and 46, with the rate of rotation being dictated by the diameter of the container and the rate of translation. When it is determined that the required distance along the X axis has been traversed, the container 20 is retracted from the platen 44 and the container, with the now fully decorated surface 24, is removed from the mandrel 72 and ejected from the machine 40. As the container 20 is being ejected, the carriage 90, platform 88 and holder 70 are returned to the home position. At the same time, the foil 60 is advanced in preparation for decoration of the next subsequent container.

It will be seen that machine 40 and the decorating process carried out by the machine are simplified by the utilization of the single drive motor 80 operated in a first mode in which appropriate registration of the container 20 is accomplished, and then in a second mode in which the container is rotated at a rate related ratiometrically to the rate of translation of the container 20 along the decorating surface 46 of the platen 44 to assure rolling contact between the surface 24 of the container 20 and the decorating surface 46 and to maintain the necessary zero relative velocity between the surface 24 of the container 20 and the decorating surface 46 of the platen 44 at the area of contact 132. Machine 40 readily accommodates containers of various diameters and containers having previously applied textual or decorative materials along specified portions of the surface of the container, which previously applied materials require accurate registration of the decoration to be applied by machine 40. It is noted that while machine 40 attains relative translation between the container 20 and the decorating surface 46 of the platen 44 by moving holder 70, and hence the container 20, along the X axis, while the platen 44 and the foil 60 are maintained stationary, it is apparent that the requisite relative translation between the container 20 and the decorating means provided by decorating surface 46 can be attained by an alternate arrangement (not shown) in which the platen 44 and the foil 60 would be moved along the X axis, while the location of the holder 70, and the container 20 thereon, along the X axis would be maintained constant.

It is to be understood that the above detailed description of preferred embodiments of the invention is provided by way of example only. Various details of design, construction and operation may be modified without departing from the true spirit and scope of the invention as set forth in the accompanying claims.

The embodiments of the invention in which an exclusive property or privilege is claimed are defined as follows:

1. In apparatus for decorating a surface of a tubular container, or a similar item, with a decorating medium by registering the surface of the container appropriately relative to a corresponding surface of a decorating means and effecting relative movement of the container along the decorating means to transfer the decorating medium from the surface of the decorating means to the surface of the container, while maintaining at zero the relative velocity between the surface of the container and the surface of the decorating means at an area of transfer of the decorating medium from the surface of the decorating means to the surface of the container, the container having a registration mark thereon, the improvement comprising:

a holder for holding the container;

a motor coupled to the holder for rotating the holder and the container held on the holder in response to operation of the motor;

detector means juxtaposed with the holder in position to detect the location of the registration mark when the registration mark is placed at a predetermined position relative to the decorating means;

a controller coupled with the motor for controlling the operation of the motor and coupled with the detector means such that the motor initially is operated in a first mode for effecting registration of the mark at the predetermined position and subsequently is operated in a second mode of operation for effecting transfer of the decorating medium from the decorating means to the container, the first mode of operation being independent of the second mode of operation; and translating means for effecting relative movement between the holder and the decorating means to bring the surface of the container into contact with the surface of the decorating means at the area of transfer of the decorating medium when the surface of the container is registered appropriately relative to the corresponding surface of the decorating means, and for subsequently effecting relative translation between the holder and the decorating means while the motor is operated in the second mode of operation to transfer decorating medium from the decorating means to the container, the rate of rotation of the holder being related to the rate of translation such that the relative velocity between the surface of the container and the corresponding surface of the decorating means is maintained at zero at the area of transfer of the decorating medium.

2. The invention of claim 1 wherein each mode of operation of the motor includes rotation of the motor at a selected rate of rotation.

3. The invention of claim 2 wherein the rate of rotation of the motor in the first mode of operation is different from the rate of rotation of the motor in the second mode of operation.

4. The invention of claim 1 wherein the tubular container includes a cylindrical portion having a circular cross-sectional configuration, the surface of the container to be decorated is located on the outer periphery of the cylindrical portion, and the holder includes a cylindrical mandrel for reception within the cylindrical portion.

5. The invention of claim 4 wherein the detector means includes a photoelectric detector juxtaposed with the cylindrical mandrel.

6. The invention of claim 1 wherein the detector means includes a photoelectric detector juxtaposed with the holder.

7. The invention of claim 1 wherein the controller includes registration means responsive to the detector means for discontinuing operation of the motor in the first mode of operation in response to detecting the arrival of the registration mark in the vicinity of the predetermined position, and subsequently operating the motor in a further mode of operation to bring the registration mark precisely to the predetermined position.

8. The invention of claim 7 wherein the motor is a servo motor.

9. The invention of claim 7 wherein the detector means includes a photoelectric detector juxtaposed with the holder.

10. The invention of claim 9 wherein the tubular container includes a cylindrical portion having a circular cross-sectional configuration, the surface of the container to be decorated is located on the outer periphery of the cylindrical portion, and the holder includes a cylindrical mandrel for reception within the cylindrical portion.

11. The invention of claim 10 wherein the motor is a servo motor.

12. In a method for decorating a surface of a tubular container, or a similar item, with a decorating medium by registering the surface of the container appropriately relative to a corresponding surface of a decorating means and effecting relative movement of the container along the decorating means to transfer the decorating medium from the surface of the decorating means to the surface of the container, while maintaining at zero the relative velocity between the surface of the container and the surface of the decorating means at an area of transfer of the decorating medium from the surface of the decorating means to the surface of the container, the container having a registration mark thereon and being held upon a holder coupled to a motor for rotating the holder and the container thereon in response to operation of the motor, the improvement comprising:

operating the motor in a first mode of operation to bring the registration mark toward a predetermined position relative to the decorating means;

detecting the location of the registration mark when the registration mark is placed at the predetermined position relative to the decorating means;

bringing the surface of the container and the surface of the decorating means into contact at the area of transfer of the decorating medium when the surface of the container is registered appropriately relative to the corresponding surface of the decorating means;

subsequently operating the motor in a second mode of operation independent of the first mode of operation; and effecting relative translation between the container and the decorating means while operating the motor in the second mode of operation, with the rate of rotation of the container related to the rate of translation such that the relative velocity between the surface of the container and the corresponding surface of the decorating means is maintained at zero at the area of transfer of the decorating medium

13. The invention of claim 12 wherein each mode of operation of the motor includes rotation of the motor at a selected rate of rotation and the rate of rotation of the motor in the first mode of operation is different from the rate of rotation of the motor in the second mode of operation.

14. The invention of claim 12 including discontinuing operation of the motor in the first mode of operation in response to detecting the arrival of the registration mark in the vicinity of the predetermined position, and subsequently operating the motor in a further mode of operation to bring the registration mark precisely to the predetermined position.

15. In an apparatus for decorating a surface of a tubular container, or a similar item, with a decorating medium by registering the surface of the container appropriately relative to a corresponding surface of a decorating means and effecting relative movement of the container along the decorating means to transfer the decorating medium from the surface of the decorating means to the surface of the container, while maintaining at zero the relative velocity between the surface of the container and the surface of the decorating means at an area of transfer of the decorating medium from the surface of the decorating means to the surface of the container, the container having a registration mark thereon and being held upon a holder coupled to a motor for rotating the holder and the container thereon in response to operation of the motor, the improvement comprising:

means for operating the motor in a first mode of operation to bring the registration mark toward a predetermined position relative to the decorating means;

means for detecting the location of the registration mark when the registration mark is placed at the predetermined position relative to the decorating means;

means for bringing the surface of the container and the surface of the decorating means into contact at the are of transfer of the decorating medium when the surface of the container is registered appropriately relative to the corresponding surface of the decorating means;

means for subsequently operating the motor in a second mode of operation independent of the first mode of operation; and means for effecting relative translation between the container and the decorating means while operating the motor in the second mode of operation, with the rate of rotation of the container related to the rate of translation such that the relative velocity between the surface of the container and the corresponding surface of the decorating means is maintained at zero at the are of transfer of the decorating medium.

16. The invention of claim 15 including:

means for discontinuing operation of the motor in the first mode of operation in response to detecting the arrival of the registration mark in the vicinity of the predetermined position; and means for subsequently operating the motor in a further mode of operation to bring the registration mark precisely to the predetermined position.

* * * * *